US007264262B2

(12) United States Patent
Zanco

(10) Patent No.: US 7,264,262 B2
(45) Date of Patent: Sep. 4, 2007

(54) SNOW SKIS

(75) Inventor: Alain Zanco, Gillomay (FR)

(73) Assignee: Skis Rossignol SA, Voiron (FR)

( * ) Notice: Subject to any disclaimer, the term of this patent is extended or adjusted under 35 U.S.C. 154(b) by 59 days.

(21) Appl. No.: 10/833,669

(22) Filed: Apr. 28, 2004

(65) Prior Publication Data

US 2004/0217577 A1 Nov. 4, 2004

(30) Foreign Application Priority Data

Apr. 30, 2003 (FR) ..... 03 05298

(51) Int. Cl.
*A63C 5/048* (2006.01)

(52) U.S. Cl. ..... 280/602; 280/608; 280/609

(58) Field of Classification Search ..... 280/608, 280/609, 610, 607, 602
See application file for complete search history.

(56) References Cited

U.S. PATENT DOCUMENTS

| | | | | | |
|---|---|---|---|---|---|
| 1,998,702 | A | * | 4/1935 | Boline | 280/609 |
| 3,537,717 | A | * | 11/1970 | Caldwell | 280/602 |
| 4,300,786 | A | * | 11/1981 | Alley | 280/602 |
| 4,961,591 | A | | 10/1990 | Bejean et al. | 280/607 |
| 4,974,867 | A | | 12/1990 | Rullier et al. | 280/607 |
| 5,249,819 | A | * | 10/1993 | Mayr | 280/602 |
| 5,280,943 | A | * | 1/1994 | Commier et al. | 280/609 |
| 5,333,889 | A | * | 8/1994 | Piegay et al. | 280/602 |
| 5,447,322 | A | | 9/1995 | le Masson et al. | 280/602 |
| 5,553,884 | A | * | 9/1996 | Abondance | 280/609 |
| 5,573,264 | A | * | 11/1996 | Deville et al. | 280/602 |
| 5,865,459 | A | * | 2/1999 | Piegay | 280/602 |
| 5,871,223 | A | | 2/1999 | Zanco | 280/607 |
| 5,944,336 | A | * | 8/1999 | Fagot | 280/607 |

FOREIGN PATENT DOCUMENTS

| | | | |
|---|---|---|---|
| FR | 2565116 | | 12/1985 |
| FR | 2610527 | | 8/1988 |
| JP | 54098831 | A * | 8/1979 |

* cited by examiner

*Primary Examiner*—Christopher P. Ellis
*Assistant Examiner*—John Walters
(74) *Attorney, Agent, or Firm*—Fay Sharpe LLP

(57) ABSTRACT

A snow sliding device such as a ski, a monoski, or a snowboard, has a plane of general symmetry P. It includes a principal part, called a body or base 2, which has a longitudinal rib 11 formed between two lateral channels 5*a*, 5*b* which open laterally toward the exterior EX and upward HA, and which do not open downward BA. A thin, lower lateral edge 20 extends below the channel. In each of the channels 5*a*, 5*b*, a complementary lateral element 3*a*, 3*b*, respectively, is attached. A height H of the ski, which corresponds to a distance between an upper surface 30 of the complementary lateral elements 3*a*, 3*b* and a lower sliding surface 6, is variable.

10 Claims, 12 Drawing Sheets

SNOW SKIS

BACKGROUND OF THE INVENTION

The present invention relates to skis, monoskis, snowboards, and other devices for sliding on snow. More particularly, it concerns an improvement with respect to a snow sliding device comprising a support base on which is attached at least one complementary element.

In recent years, sliding on snow as an athletic activity has been increasingly adapted and developed with practitioners demanding increasingly higher quality products. This is the case, for example, in the sport of sliding on snow.

A large number of models of snow sliding devices, notably skis, constitute an elongated plank whose front end is raised to form a spatula and whose lower surface comprises a sliding sole with metal edges.

In spite of efforts by equipment manufacturers and designers to satisfy their clients, there is still no ski which perfectly combines user comfort with performance characteristics, regardless of the type of terrain or the type of user.

SUMMARY OF THE INVENTION

The present invention proposes multi-purpose skis formed with a support base and at least one complementary element whose shape, dimensions, and structure cooperate to provide these handling characteristics, as well as comfort and convenience.

Consequently, according to the invention, a snow sliding device, such as a ski, a monoski, or a snowboard, with a plane of generally vertical symmetry of the type which includes a principal part, called a body or support base, having a longitudinal rib formed between two lateral channels. The channels open upward and to the sides, but not toward the bottom which a lateral edge is disposed. A lateral complementary element is attached in each channel. The height of the ski, corresponding to a distance between an upper surface of the complementary lateral element and a sliding surface, is non-constant.

According to one embodiment, the thickness of the lower lateral edge of the base, like the height of the complementary elements, are variable.

According to another embodiment, the thickness of the lower lateral edge of the base, like the height of the complementary elements, diminish progressively from the center of the ski towards the front and/or the rear.

According to another embodiment, the thickness of the lower lateral edge of the base is constant and the height of the complementary element is variable, diminishing progressively from the center of the ski toward the front and/or rear.

In accordance with another embodiment, the thickness of the lower lateral edge of the base is variable and diminishes progressively from the center of the ski towards the front and rear and the height of the complementary element is constant.

According to another embodiment, the height of one of the complementary lateral elements is equal to or greater than the height of the corresponding disengagement channel.

According to another embodiment, the width or amplitude of the lateral disengagement channel is variable longitudinally and is more significant at the center of the ski and diminishes toward the front and rear.

It should be noted that one of the lateral complementary elements are advantageously of a transverse section which varies in size or form.

According to another embodiment, the width or amplitude of the complementary lateral elements varies longitudinally, being most significant at the center of the ski and diminishing towards the front and/or rear.

According to another embodiment, the length of the lateral complementary elements is equal to or greater than 30% of the length of the base while the height of the profile of each is slightly higher than the height of the corresponding disengagement channel.

Still further advantages of the present invention will be appreciated to those of ordinary skill in the art upon reading and understand the following detailed description.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

FIG. 1 is a bird's eye view of a ski showing its support base with its two complementary lateral elements;

FIG. 2 is a side view of a ski illustrating its support base with its two complementary lateral elements;

FIG. 3 is a perspective view illustrating placement of the complementary lateral elements in the support base;

FIG. 4 is a perspective view of a ski with the complementary lateral elements mounted to the base;

FIGS. 5A, 5B, 5C, 5D, and 5E are enlarged, transverse sectional views through Sections A-A, B-B, C-C, D-D, and E-E, respectively, illustrating insertion of the lateral support elements into the base;

FIGS. 6A, 6B, 6C, 6D, and 6E are enlarged, sectional views through Sections A-A, B-B, C-C, D-D, and E-E, respectively, of the ski with its complementary lateral elements mounted to the support base;

FIG. 8 is a side view showing how the two complementary elements can be mounted on the support base;

FIG. 10 is a transverse sectional view of the lateral elements of a ski of this type and the associated lateral elements;

DETAILED DESCRIPTION OF THE PREFERRED EMBODIMENTS

Figure 1:
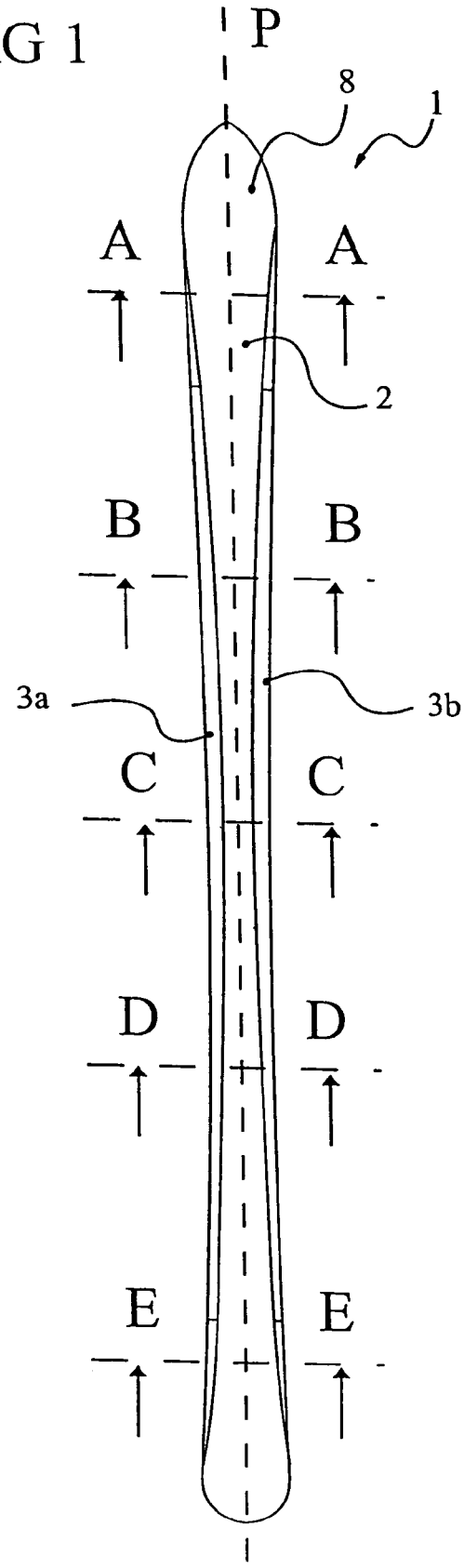
FIGS. 1, 2, 3, 4, 5A, 5B, 5C, 5D, 5E, 6A, 6B, 6C, 6D, 6E and 8 are directed to a first embodiment of the invention.
Figure 2:
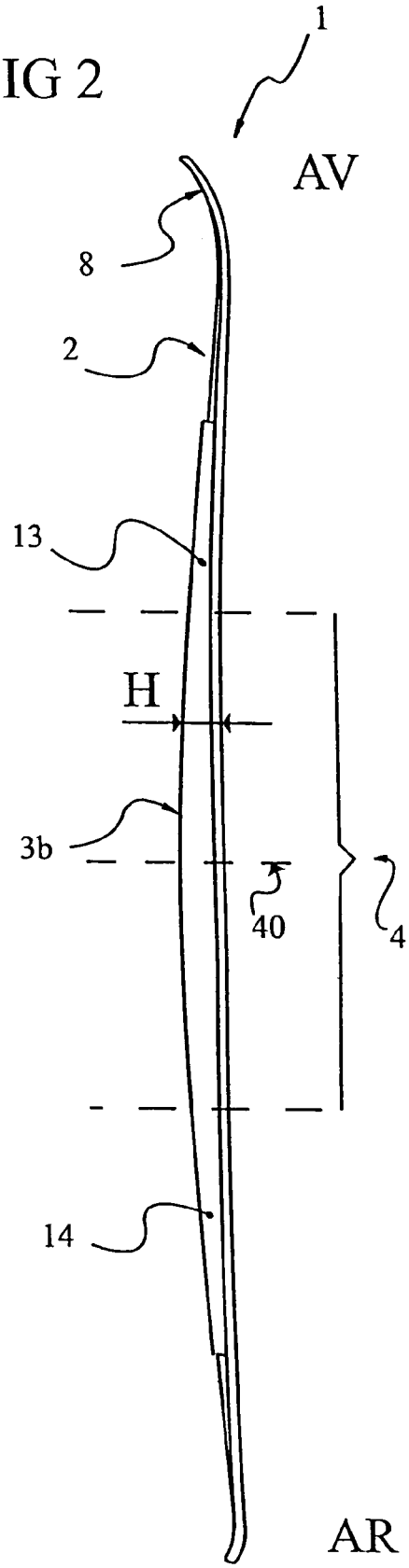
Figure 3:
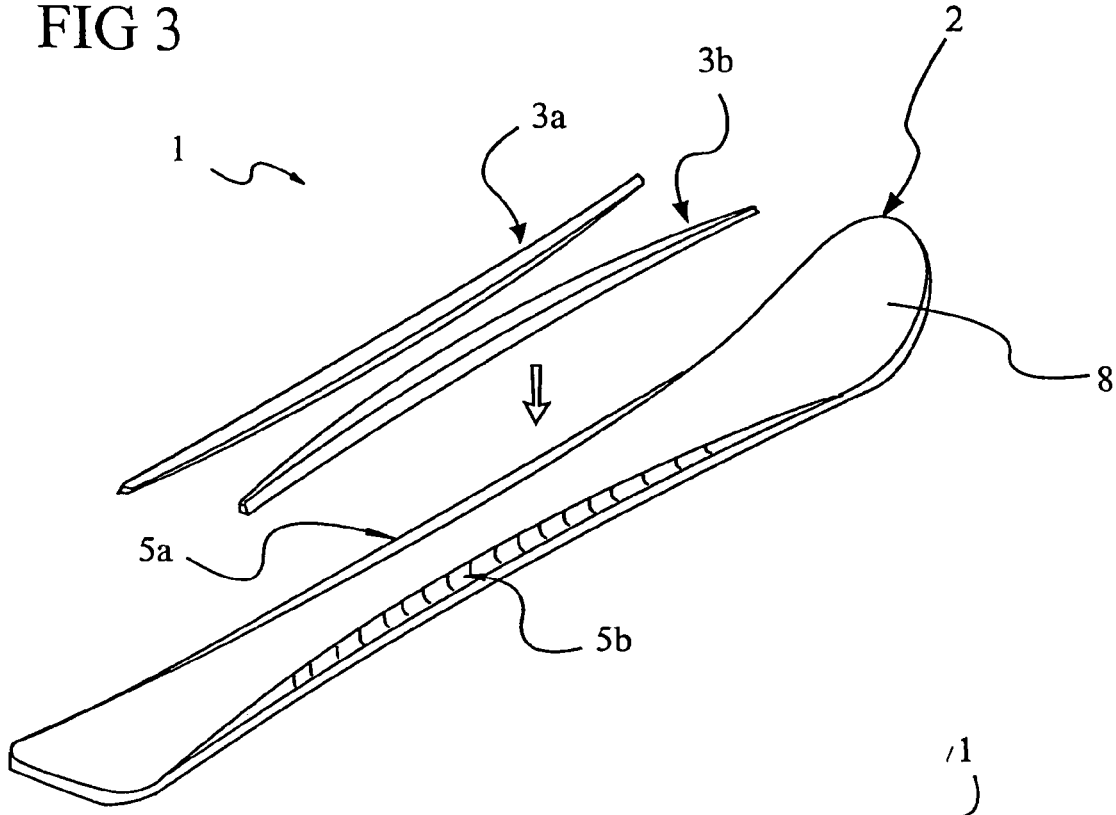
Figure 4:
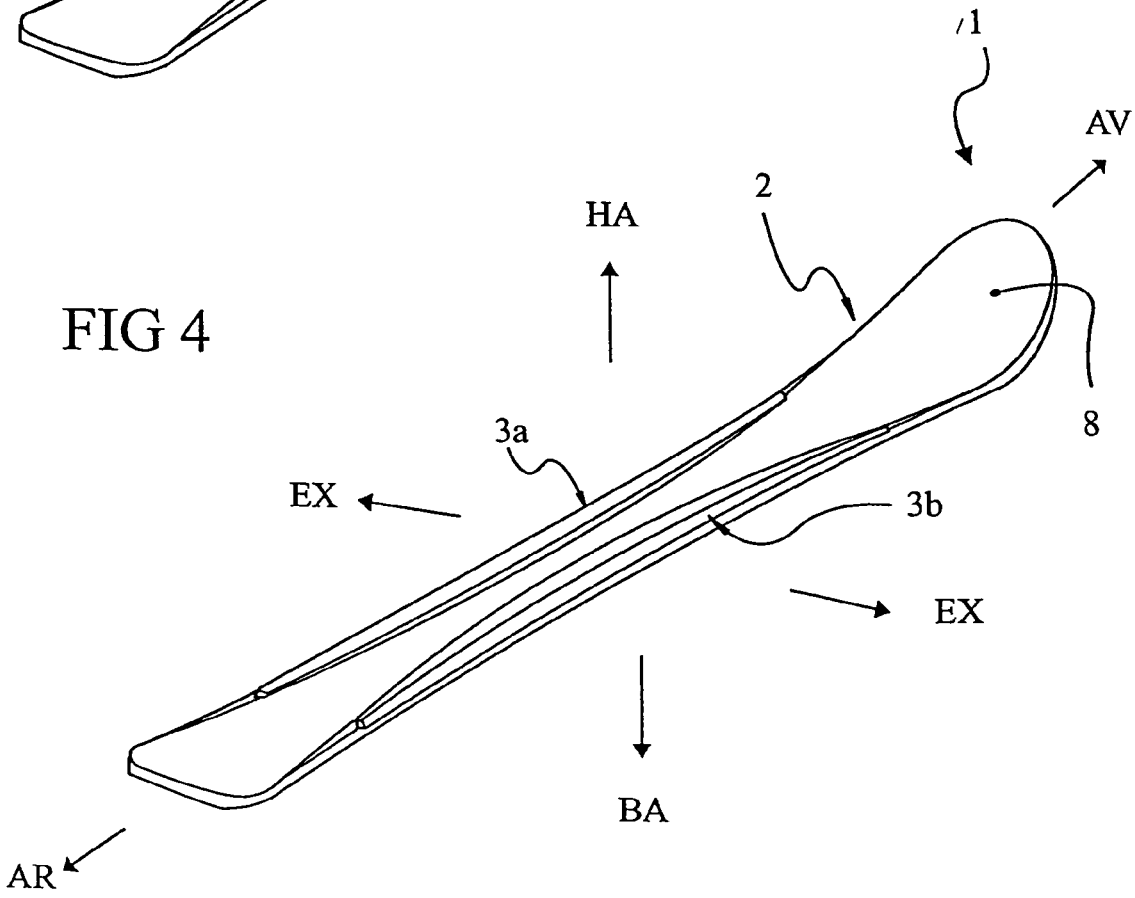
Figure 5A:
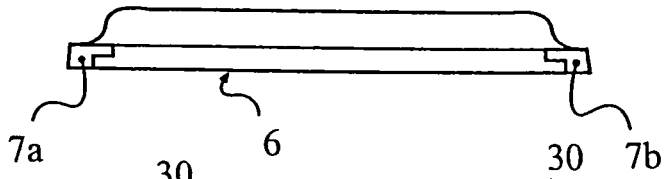
Figure 5B:
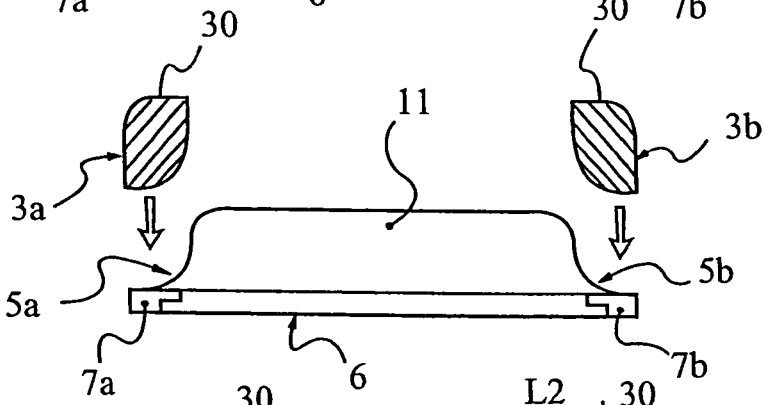
Figure 5C:
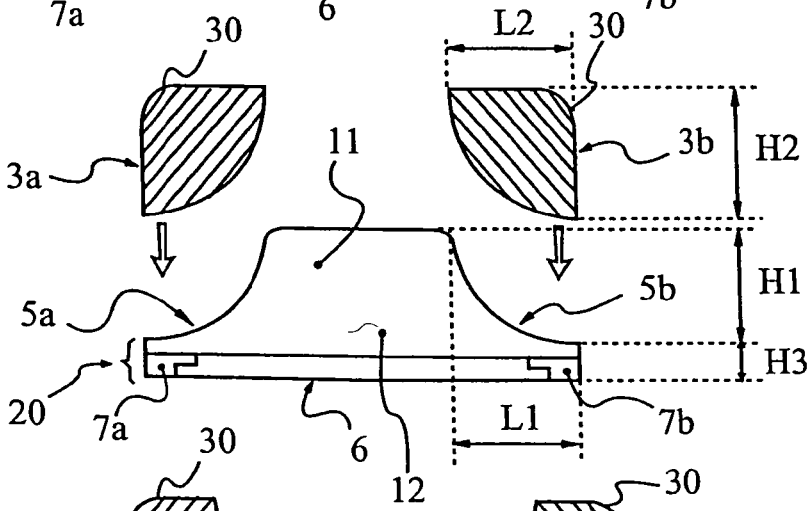
Figure 5D:
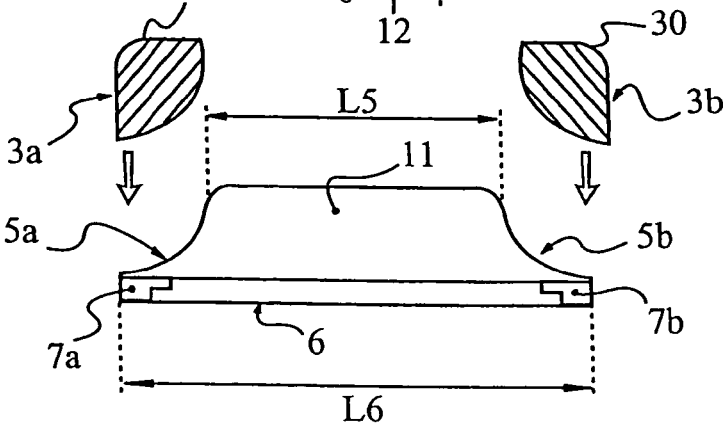
Figure 5E:
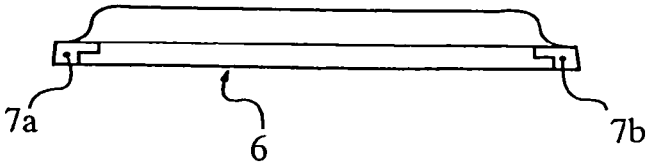
Figure 6A:
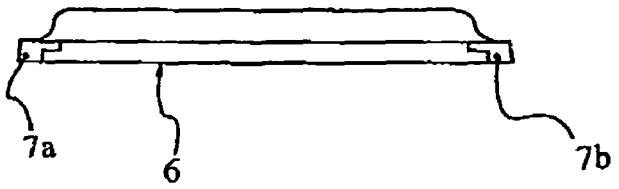
Figure 6B:
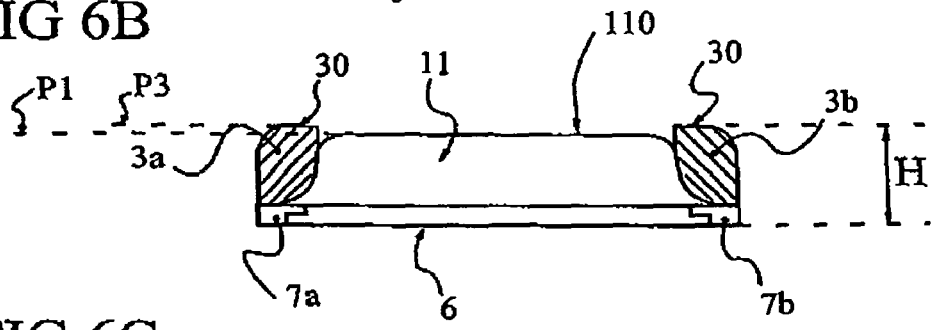
Figure 6C:
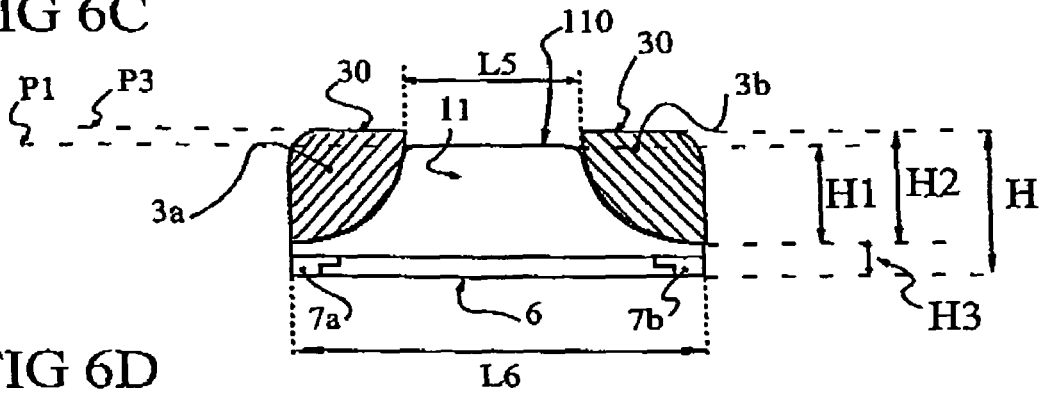
Figure 6D:
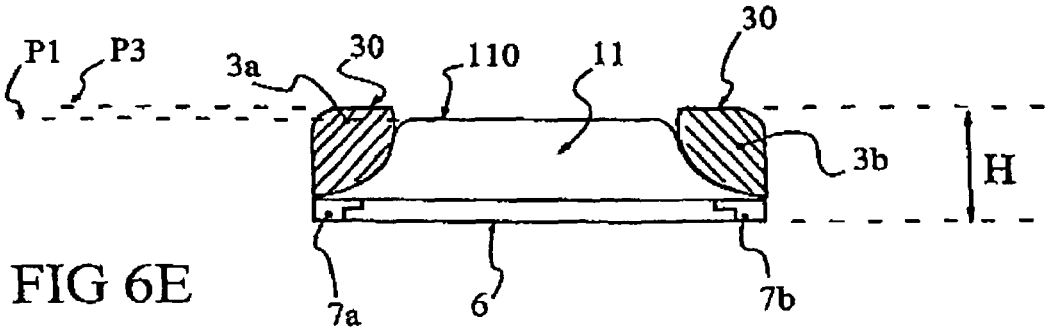
Figure 6E:
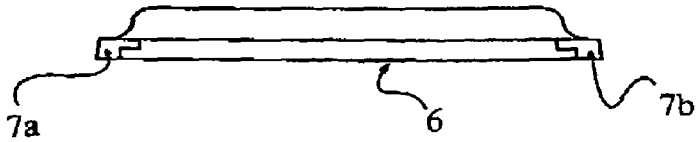

A ski 1 is assembled of longitudinal elements of elongated shape and has a central longitudinal vertical plane P of symmetry. The front end of the ski is raised to form a spatula 8. The ski 1 is formed by a principal part called a body or support base 2 on which at least one complementary element, and preferably a pair of complementary elements 3*a*, 3*b* are attached at least in the area 4 in which the bindings are mounted.

The base support 2 which is the element in contact with the snow has the shape of an elongated plank. Its lower surface defines a sliding sole 6 which is bordered laterally by square metal edges 7*a*, 7*b* (FIG. 5).

The base 2 is an elongated plank whose front end is raised to define a spatula 8 of the ski. The support base has a selected thickness distribution, edge contour, width, and stiffness, and can be constructed in various ways and constructions as are known in the art.

Thus, the elongated plank forming the support base 2 can be of any known design, such as, for example, sandwich-type, encasement-type, shell-type, or even of a type combining shell and lateral fields or edge strips used singly or in combination. Indeed, it can even be made of various combinations of these known elements and components.

Figure 10:
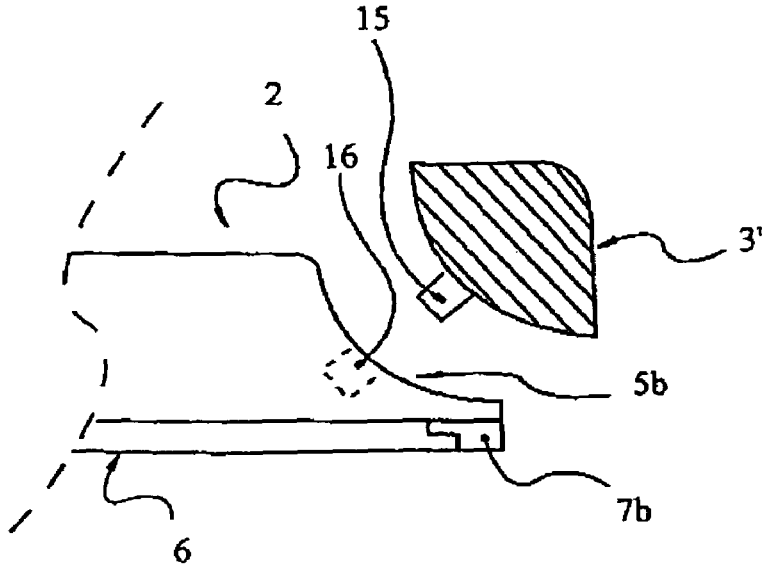
FIG. 10 is a partial diagrammatic view in partial transverse section illustrating an assured connection between the complementary elements and the support base.
Figure 10:
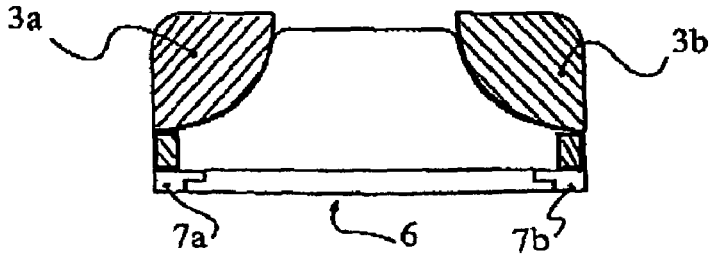

FIG. 10' is a schematic view in transverse section of a ski which combines a shell and lateral fields or edge strips.

The two complementary elements 3*a*, 3*b* are formed with elongated profiles whose transverse section tapers in its dimension and/or shape.

Like the support base 2, each of the complementary lateral elements 3*a*, 3*b* has its own configuration and structure. Each has a selected thickness, amplitude, width, and stiffness distribution, and can be of any type of construction. The complementary elements 3*a*, 3*b* can be a unitary element formed of a common material. However, they can also have other designs. For example, each can be formed by a profile having a somewhat tubular shape comprising an external wall formed, for example, of a composite material and a central portion that is hollow or filled with a filling material, such as synthetic foam.

In one embodiment, for example, each of the complementary lateral elements 3*a*, 3*b* is a profile which diminishes in width or amplitude and thickness towards the front AV and towards the rear AR.

The base includes lateral disengagement channels 5*a*, 5*b*. A corresponding one of the lateral complementary elements 3*a*, 3*b* is fixed in each of these. Thus, the support base 2 includes a left lateral channel 5*a* to which the left complementary lateral element 3*a* is fixed and a right lateral channel 5*b* to which the right complementary lateral element 3*b* is fixed.

Each of the lateral channels 5*a*, 5*b* extends laterally towards the exterior EX and in an upward direction HA, but it does not extend in a downward direction BA.

The width L1 of the channels is preferably variable longitudinally, being largest at the center of the ski and diminishing towards the front AV or towards the rear AR and preferably towards both the front and the rear.

Likewise, the height H1 of the channels 5*a*, 5*b* is preferably variable longitudinally and preferably diminishes progressively towards the front or the rear, and preferably towards both the front and the rear.

In the preferred embodiment, the height H2 of each of the complementary lateral elements 3*a*, 3*b* is slightly higher than the height H1 of the corresponding channel 5*a*, 5*b* along all or part of the length of the complementary element. But, according to the preferred embodiment, the height H2 of the two complementary elements 3*a*, 3*b* is slightly higher than the height H1 of the corresponding channel 5*a*, 5*b*.

Thus, the plane P3 of the upper surface 30 of the lateral complementary elements 3*a*, 3*b* is situated above the plane P1 of the top surface 110 of the longitudinal rib 11.

According to the embodiment illustrated in FIGS. 17A, 17B, 17C, 17D, and 17E, the height H2 of each of the complementary lateral elements 3*a*, 3*b* is equal to the height H1 of the corresponding channel 5*a*, 5*b* along the whole length of the complementary elements. Thus, the general plane P3 of the upper surface 30 of the complementary elements 3*a*, 3*b* is situated in the same general plane P1 as the upper surface 110 of the longitudinal rib 11. Therefore, the height H2 of each of the complementary elements 3*a*, 3*b* can be equal to or greater than the height H1 of the corresponding channel 5*a*, 5*b*.

In addition, the width L2 of the complementary elements 3*a*, 3*b* preferably varies longitudinally, being wider at the center of the ski and preferably diminishing progressively from the center 40 of the ski 1 toward the front AV or the rear AR. Their height H2 is also preferably variable progressively longitudinally towards the front AV and the rear AR, being greater at the center 40 of the ski 1 and diminishing towards the front AV or towards the rear AR, preferably towards both the front and the rear.

With regard to the height H, the thickness of the ski 1, which is to say the base 2 plus the complementary lateral elements 3*a* , 3*b*, is equal to the distance between the upper surface 30 of the complementary lateral elements 3*a*, 3*b* and the lower, sliding surface 6. The height H corresponding to the thickness of the ski 1 at the level of the lateral complementary elements 3*a*, 3*b* is equal to the height H2 of the complementary lateral elements 3*a*, 3*b* plus the thickness H3 of the lateral edge 20 of the base 2.

It will be noted that the height H preferably diminishes progressively toward the front or towards the rear, and preferably towards both the front and the rear.

Figure 18:
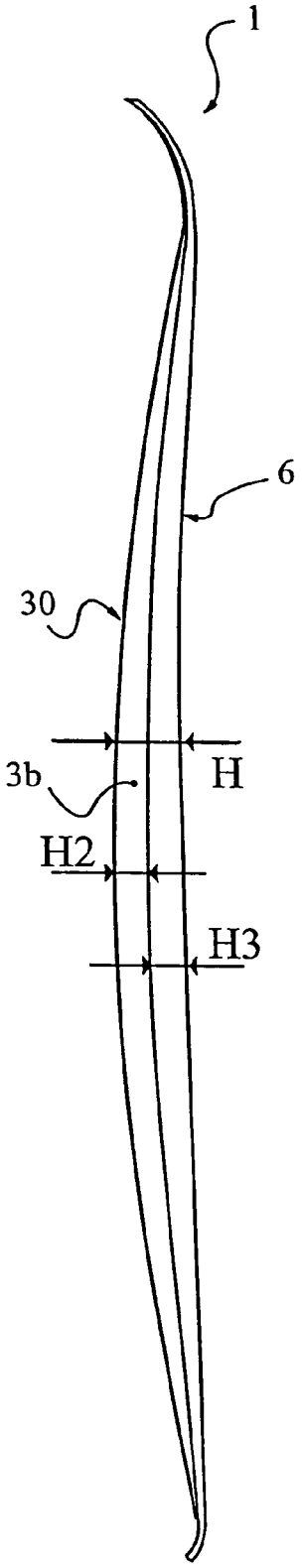
FIGS. 18, 19, and 20 are side views of three more embodiments of the skis and complementary elements.
Figure 19:
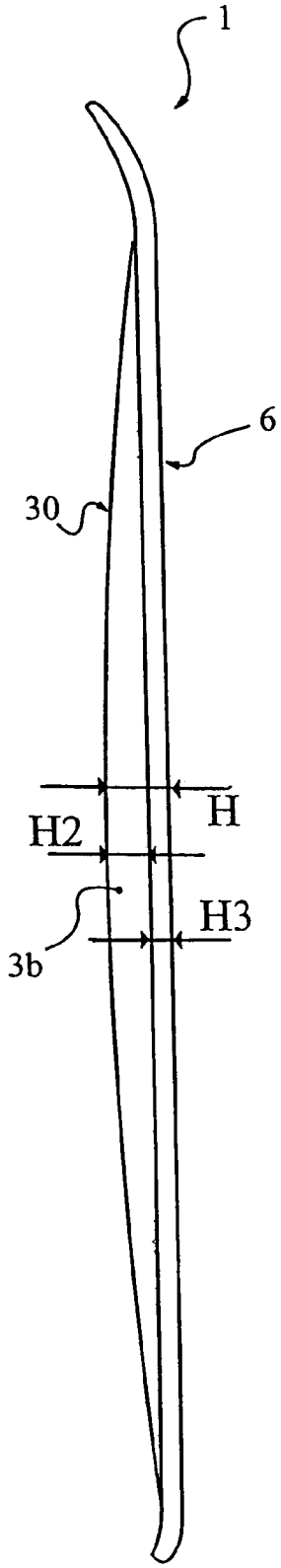
Figure 20:
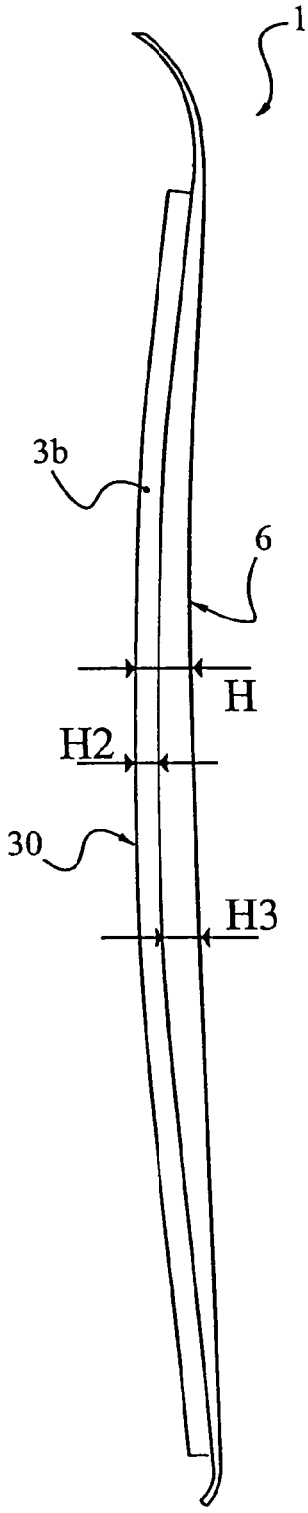

This variation in height H can be obtained in various ways:

(a) the lateral edge 20 of the base 2 of thickness H3 varies such that it progressively diminishes from the center 40 of the ski 1 toward the front and toward the rear while the height H2 of the complementary elements 3*a*, 3*b* diminishes progressively from the center of the ski toward the front and toward the rear, as is illustrated in FIG. 18;

(b) the lateral edge 20 of the base 2 has a constant thickness H3 while the height H2 of the complementary elements 3*a*, 3*b* diminishes progressively from the center of the ski toward the front and toward the rear such as is illustrated in FIG. 19; and (c) the lateral edge 20 of the base 2 has a width H3 which diminishes progressively from the center of the ski toward the front and toward the rear while the height H2 of the complementary elements 3*a*, 3*b* is constant, such as is illustrated in FIG. 20.

By way of example, the length L3 of the complementary lateral elements 3*a*, 3*b* can stretch the whole or part of the length of the base. It can be, for example, equal to or greater than 30% of the length L4 of the base 2 and may, for example, be between 30% and 90%. The length L3 of the complementary elements can, for example, range between 50 cm and 150 cm for a ski that is 170 cm in length.

The two complementary lateral elements 3*a*, 3*b* preferably have the same length, but can have different lengths.

The shape of each of the elements in transverse section can be as illustrated, but can also be square, round, rectangular, or of other cross-section. Note also that the shape of the section can taper and vary longitudinally.

According to a complementary embodiment, a set of several complementary lateral elements 3*a*, 3*b*; 3'*a*, 3'*b*; 3"*a*, 3"*b* can correspond to one support base 2.

Figure 7:
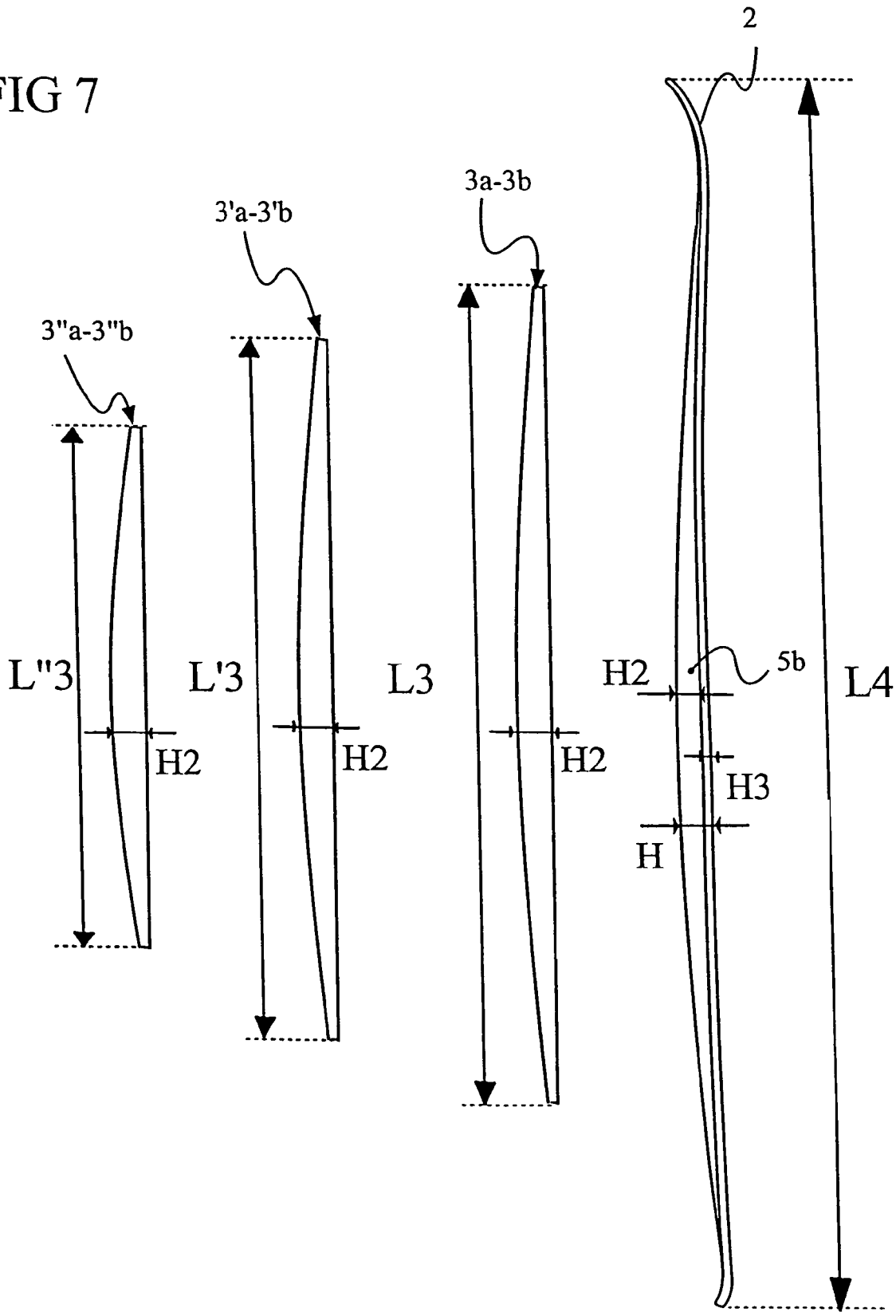
FIG. 7 is a side view showing several different complementary elements which can be mounted in the same support base.
Figure 8:
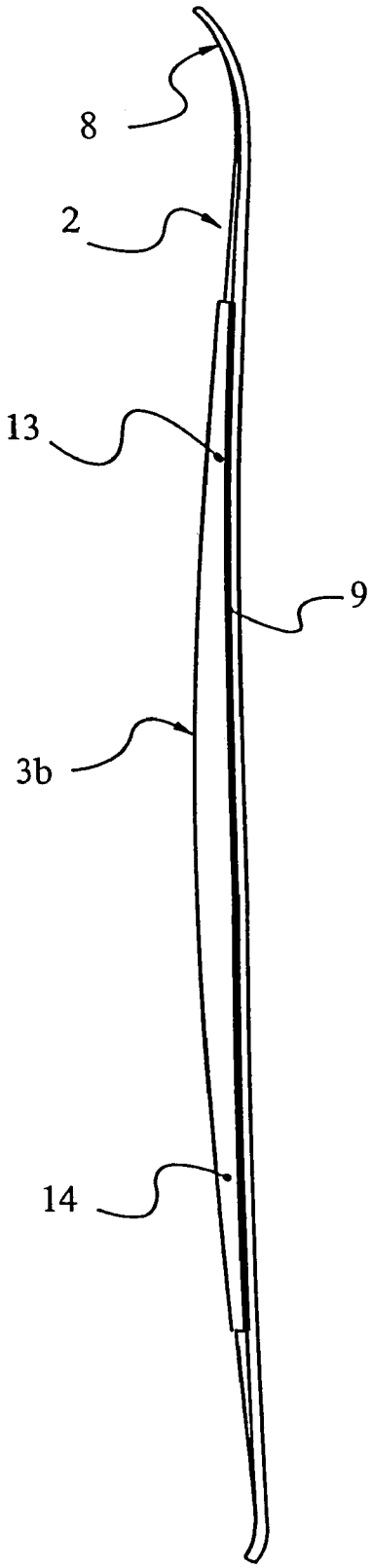
Figure 9:
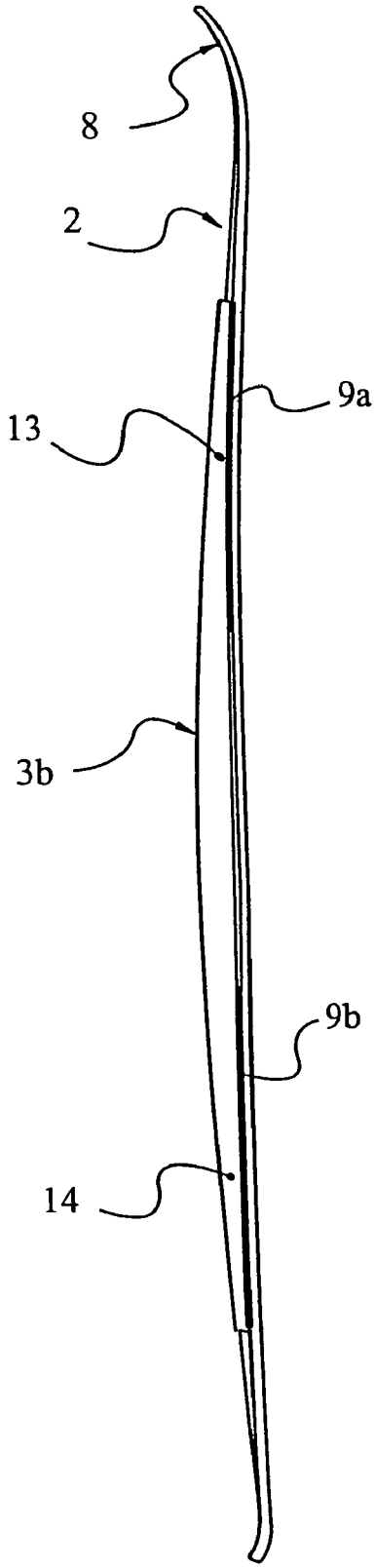
FIG. 9 is a side view illustrating an alternate embodiment to the embodiment of FIG. 8.

Thus, several complementary elements 3*a*, 3*b* of different lengths L3, L'3, L"3 can correspond to a given support base, such as, for example, the three complementary elements of different lengths illustrated in FIG. 7. Likewise, several complementary elements of different thickness can correspond to a given base. Note also that a given base 2 can correspond also to a plurality of complementary elements of different mechanical characteristics for conferring to the ski 1 which is made up of the base 2 and the complementary elements 3*a*, 3*b*, and different handling characteristics. The different characteristics can be obtained by different thicknesses of the complementary elements or by different structures, even by different materials, even by different geometries. The attaching of the complementary elements 3*a*, 3*b* on the support base 2 takes place by placing and attaching the complementary elements within the corresponding channels 5*a*, 5*b*. They can be attached by glue or welding. The attachment 9 can also be effected over the entire length of the surface of the complementary element 3*a*, 3*b* as illustrated in FIG. 8, or the connection 9*a*, 9*b* can be affected over only part of the common surface, for example, in the zones of the front portion 13 and the rear portion 14 as represented in FIG. 9.

It is possible to provide for the connection of the complementary elements 3*a*, 3*b* with the support base 2 to be accomplished mechanically, such as, for example, by embedding projections 15 into corresponding holes 16, as illustrated in FIG. 10.

It is to be noted that the thickness of the complementary elements 3*a*, 3*b* can be constant or variable.

Figure 11:
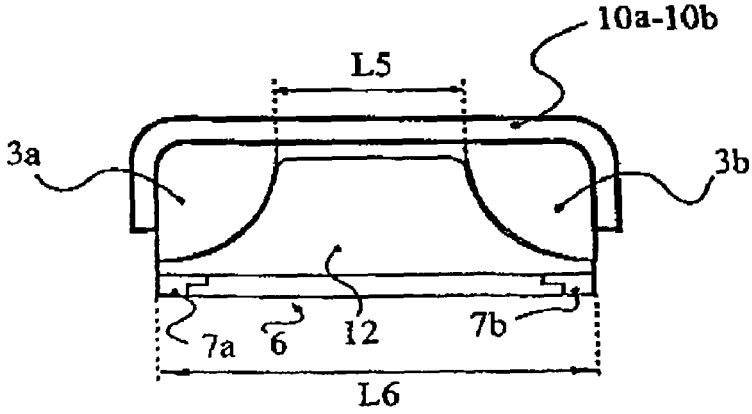
FIG. 11 is a transverse view of another embodiment of a ski in which the bindings are fixed on a strap connected to the complementary lateral elements.
Figure 12:
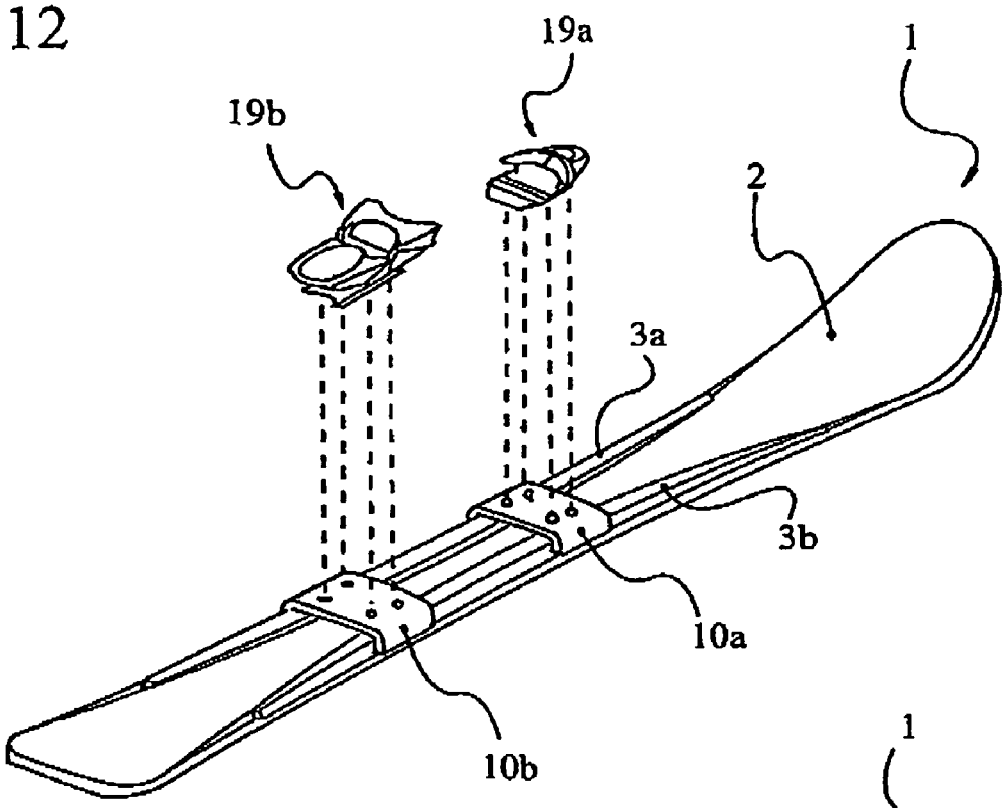
FIG. 12 is a perspective view of the ski of FIG. 11.

FIGS. 11 and 12 illustrate how the ski bindings 19*a*, 19*b* for retaining the boot of the skier can be fastened. To this end, two straps are provided, for example a front strap 10*a* and a rear strap 10*b* on which the bindings 19*a*, 19*b* can be attached. The straps are fixed on the complementary lateral elements. It should be noted that the strap can be fastened to the complementary lateral elements 3*a*, 3*b* by any known means, such as by glue, screw connections, etc.

The bindings 19*a*, 19*b* could be not fastened to the intermediate strap, such as the previously described straps, but could be fastened to the complementary lateral elements 3*a*, 3*b*, or, of course, to the support base 2.

Figure 13:
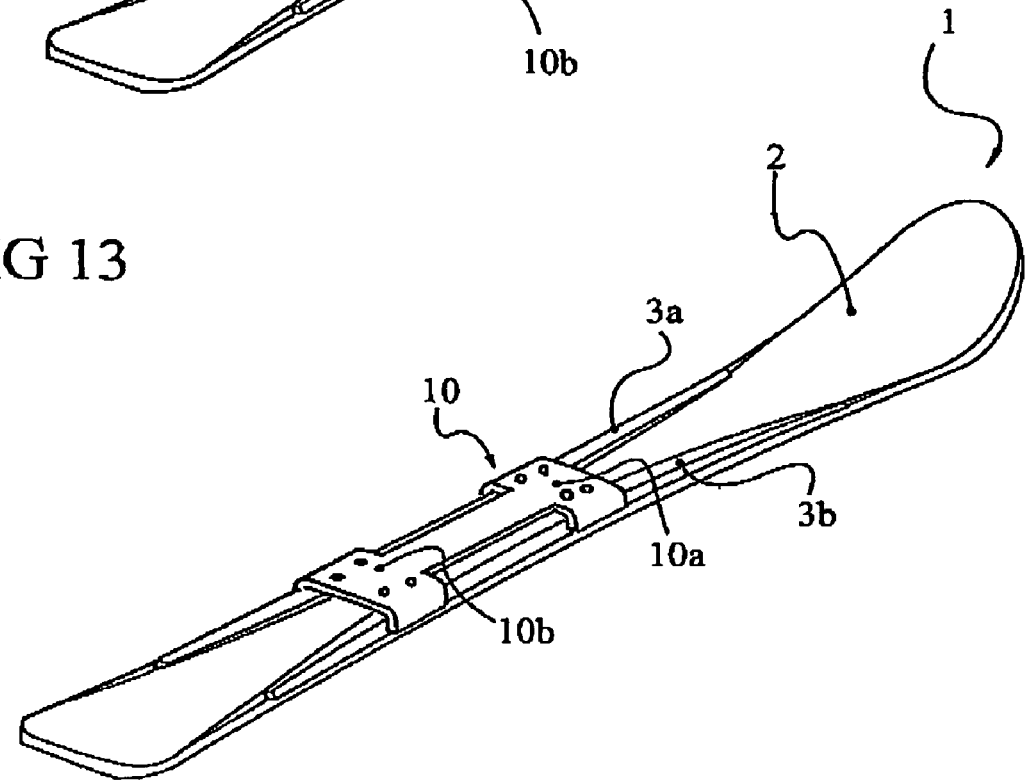
FIG. 13 is a perspective view similar to FIG. 12 illustrating a variation in the bindings.

FIG. 13 is a view similar to FIG. 12 depicting an alternate embodiment in which two straps 10*a*, 10*b* are connected with each other in order to form a common strap 10.

Figure 14:
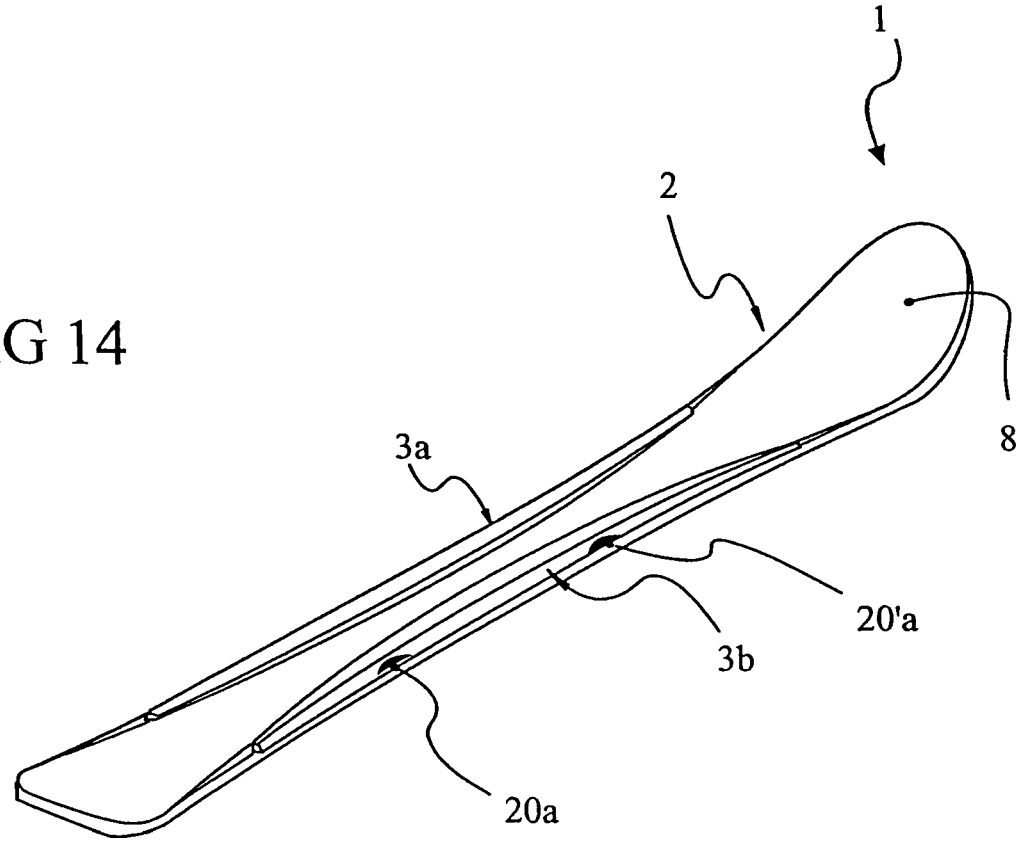
FIG. 14 is a perspective view of a first of three embodiments in which the lateral complementary elements include shock absorbing elements.
Figure 15:
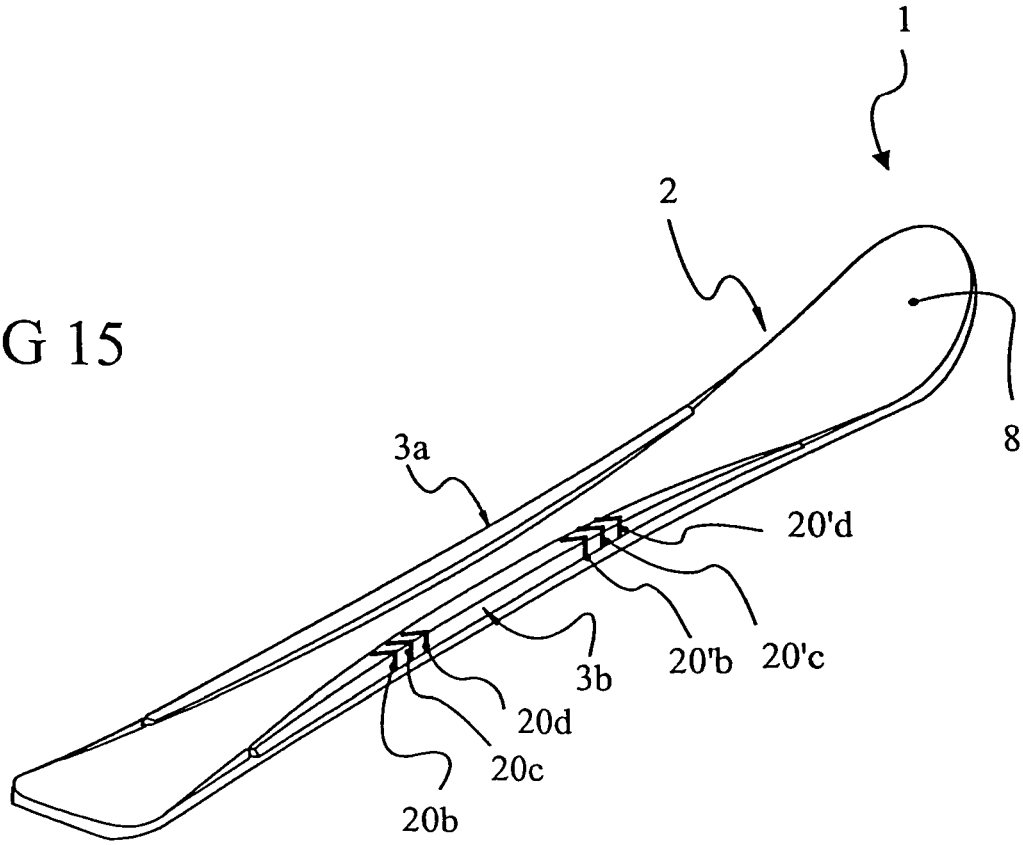
FIG. 15 is a second of the three embodiments in which the complementary lateral elements include shock absorbing elements.
Figure 16:
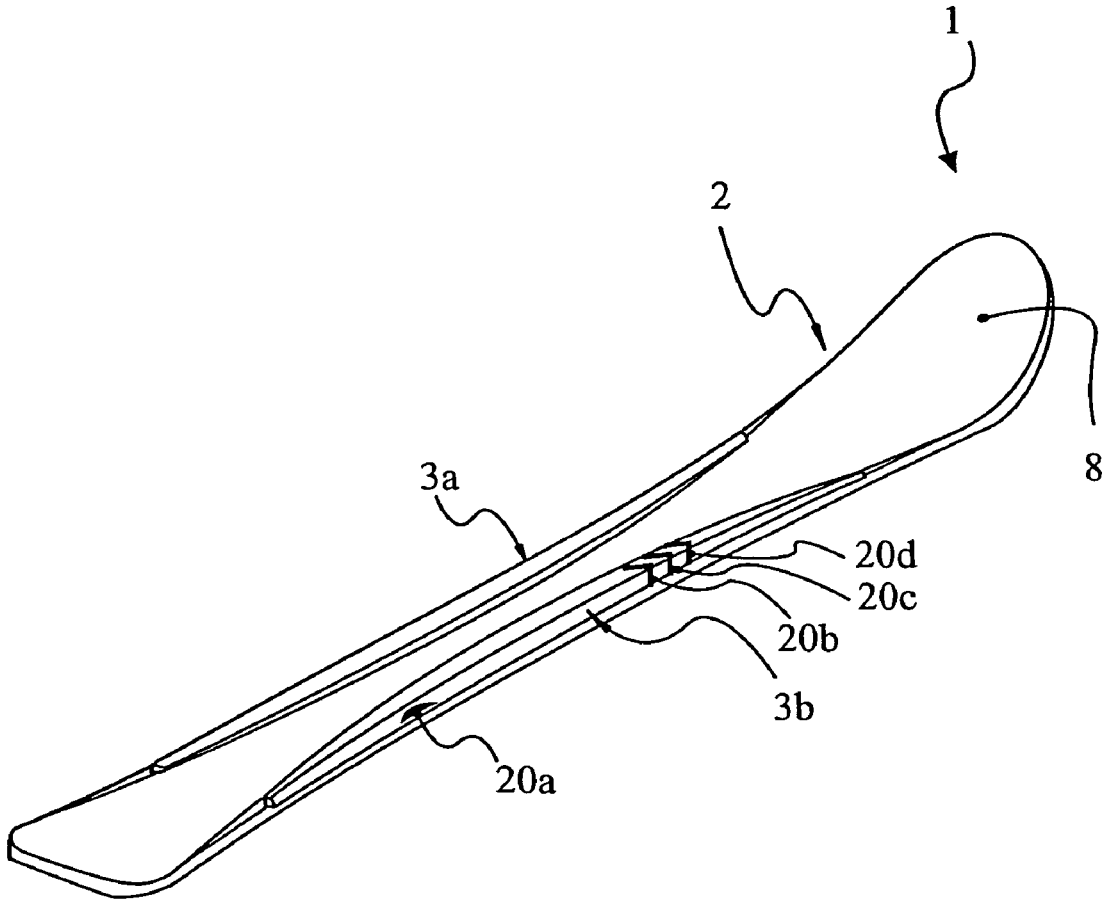
FIG. 16 is a perspective view of the third of the three embodiments in which the complementary lateral elements include shock absorbing elements.
Figure 17A:
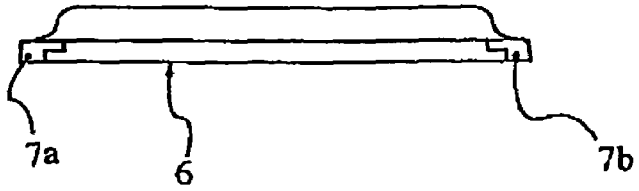
FIGS. 17A, 17B, 17C, 17D, and 17E are views similar to FIGS. 6A, 6B, 6C, 6D, and 6E, respectively, illustrating another embodiment.
Figure 17B:
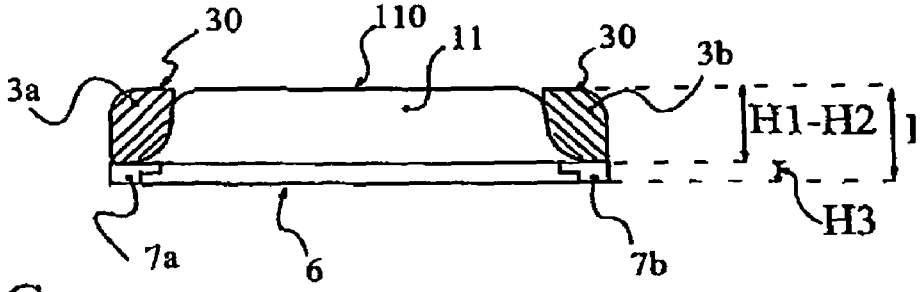
Figure 17C:
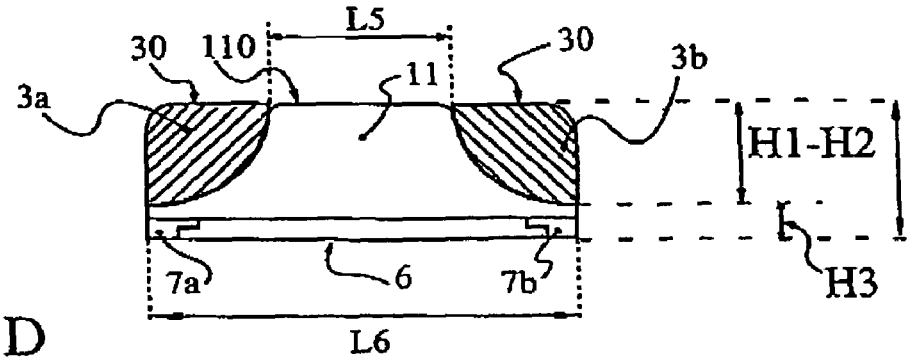
Figure 17D:
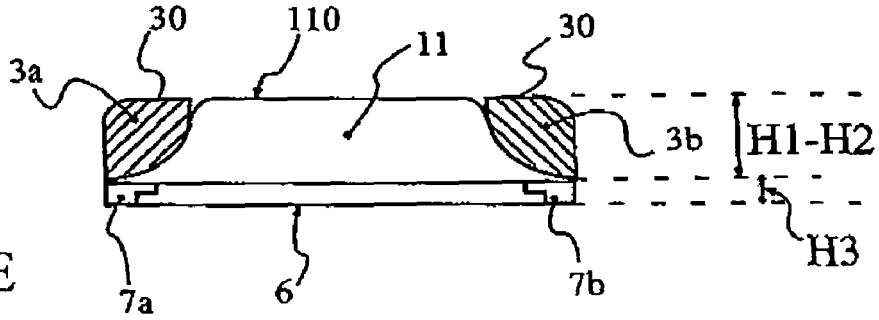
Figure 17E:
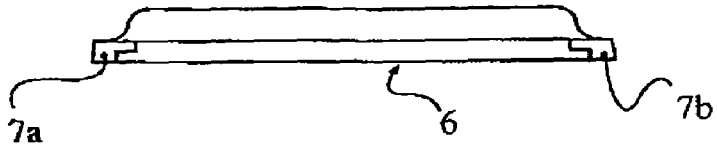

FIGS. 14, 15, and 16 are perspective views illustrating three embodiments in which cushioning and shock-absorbing elements 20*a*, 20'*a*, 20*b*, 20'*b*, 20*c*, 20'*c*, 20*d*, 20'*d* are incorporated within the complementary elements 3*a*, 3*b*. These deformable elements are formed of a resilient, elastomeric, or viscous material, such as foam, natural or synthetic rubber, or the like.

In the zone that is occupied by the complementary lateral elements, the support base 2 can include a longitudinal rib 11 bordered by the two lateral channels 5*a*, 5*b*. The rib's width L5 is smaller than the width L6 of the lower portion 12 of the base 2. Each of the lateral channels is bordered toward the plane of symmetry by the longitudinal rib and toward the base by the lower part 12 which includes the metal edges 7*a*, 7*b* of the sliding sole 6.

Optionally, the complementary left element 3*a* can different from the right complementary element 3*b* with respect to length, as was mentioned previously, as well as in cross-section, transverse dimensions, construction characteristics, and even functional characteristics.

The preceding variations are preferably implemented progressively, but can also be realized in successive steps, with or without interruptions.

Also, the upper surface 30 of one of the complementary elements 3*a* is not necessarily at the same level as the upper surface 30 of the other complementary element 3*b*.

The invention has been described with reference to the preferred embodiments. Modifications and alterations may occur to others upon reading and understanding the preceding detailed description. It is intended that the invention be constructed as including all such modifications and alterations insofar as they come within the scope of the appended claims or the equivalents thereof.

The invention claimed is:

1. A snow sliding device such as a ski, a monoski, or a snowboard, with a plane of vertical symmetry including:

a base having a longitudinal rib formed between two channels, which channels are open upward and to the sides, but not toward the bottom due to a lower lateral edge of the base;

a lateral complementary element attached in each of the channels;

a height of the ski, corresponding to a distance between an upper surface of the complementary lateral elements and a sliding lower surface of the ski, is variable, wherein the thickness of the lower lateral edge of the base is variable and a height of the complementary elements is variable, and in which the thickness of the lower lateral edge of the base and the height of the complementary elements diminish progressively from a center of the ski towards both a front and a rear of the ski.

2. The snow sliding device according to claim 1, wherein the height of at least one of the complementary lateral elements is equal to or greater than a height of the channel.

3. The snow sliding device according to claim 1, wherein the base has a constant contour along the edge, length, and stiffness.

4. The snow sliding device according to claim 3, wherein a width or amplitude of the channels is longitudinally variable, being greater at a center of the ski and diminishing toward at least one of the front and the rear of the ski.

5. The snow sliding device according to claim 1, wherein at least one of the complementary lateral elements is an elongated element.

6. The snow sliding device according to claim 1, wherein at least one of the complementary lateral elements has a transverse cross-section that changes in at least one of dimension and shape.

7. The snow sliding device according to claim 6, wherein a width or amplitude of the complementary lateral elements varies longitudinally, decreasing front a center of the ski toward at least one of a front and a rear of the ski.

8. The snow sliding device according to claim 1, wherein a length of the complementary lateral elements is equal to or greater than 30% of a length of the base.

9. The snow sliding device according to claim 1 including:

a set of interchangeable complementary lateral elements with different characteristics corresponding to the base, pairs of complementary elements of the set being removably attached in the channels.

10. A snow sliding device such as a ski, a monoski, or a snowboard, with a plane of vertical symmetry including:

a base having a longitudinal rib formed between two channels, which channels are open upward and to the sides, but not toward the bottom due to a lower lateral edge of the base;

a lateral complementary element is attached to each of the channels, the height of each of the complementary lateral elements being higher than a height of the corresponding channel;

a height of the ski, corresponding to a distance between an upper surface of the complementary lateral elements and a sliding lower surface of the ski, being variable.

* * * * *